United States Patent [19]

Thompson et al.

[11] Patent Number: 4,874,266

[45] Date of Patent: Oct. 17, 1989

[54] METHOD AND APPARATUS FOR FORMING A DESK

[75] Inventors: Marvin W. Thompson, Pasadena; Timothy C. Jennings, Arcadia; James A. Scott, Anaheim, all of Calif.; Ronald W. Phenicie, Warrenton, Va.; Margaret H. Murphy, La Verne, Calif.; Gabriel D. Nakash, Phillips Ranch, Calif.; James R. Biggers, Ontario, Calif.; Lynnlee M. Boudreau, Monrovia, Calif.; Jorge H. Curiel Contreras, Baldwin Park, Calif.

[73] Assignee: Anvil Cases, Inc., Rosemead, Calif.

[21] Appl. No.: 224,415

[22] Filed: Jul. 26, 1988

Related U.S. Application Data

[62] Division of Ser. No. 57,124, Jun. 2, 1987, Pat. No. 4,819,567.

[51] Int. Cl.[4] ..... F16B 12/02

[52] U.S. Cl. ..... 403/407.1; 248/498; 248/225.2; 292/238; 312/195; 403/330

[58] Field of Search ..... 292/338, 262, DIG. 46; 248/224.4, 225.2, 224.3, 489, 498; 403/199, 245, 407.1, 405.1, 330; 24/460, 461, 664, 684, 685; 312/194, 195, 203, 205

[56] References Cited

U.S. PATENT DOCUMENTS 1,388,035 8/1921 Gorden ..... 292/338

*Primary Examiner*—Randolph A. Reese
*Assistant Examiner*—Carol I. Bordas
*Attorney, Agent, or Firm*—Kenyon & Kenyon

[57] ABSTRACT

The disclosure relates to a system of storage components which can be converted to a desk. A storage member of orthogonal configuration has a top portion releasably secured to a bottom portion. Separable fastener enable the top portion to be removed and reattached to the bottom portion to form a desk. Additional support is provided to support the portion of the desk distal to the interface of the top and bottom portion where attached by the separable fastener. The fastener is integrated with the various portions of the storage components to provide a relatively unobtrusive surface for the desk when erected and for transport as well.

5 Claims, 4 Drawing Sheets

FIG. 6.
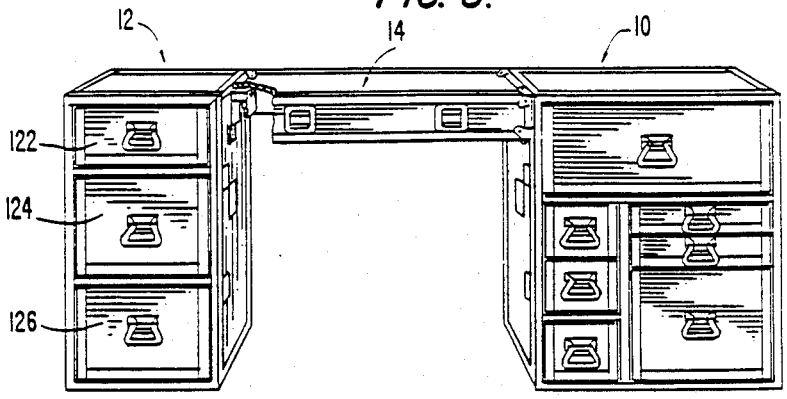
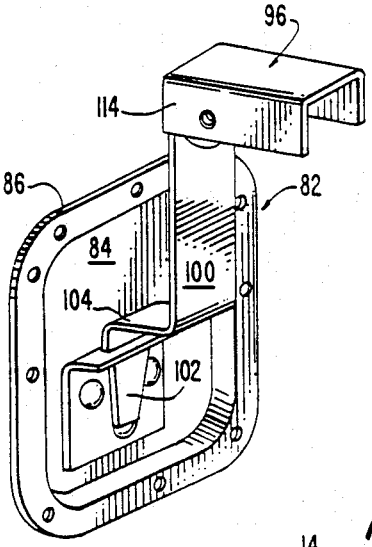
FIG. 7.
FIG. 8.
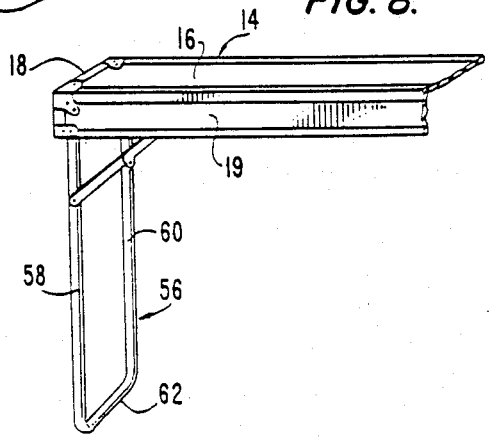

METHOD AND APPARATUS FOR FORMING A DESK

This application is a division, of application Ser. No. 057,124, filed June 2, 1987, now U.S. Pat. No. 4,819,567.

BACKGROUND AND DISCUSSION OF THE INVENTION

The invention relates to desk system which can be quickly and efficiently erected in the field or other remote areas. Often desks are erected from materials which have no other practical use except to form a desk or desk top once fully constructed. Consequently, when materials used to form the desk are stored, they simply take up what otherwise would be functional space. Particularly for operations which require continual movement or transport effective utilization of space can be a major concern. Where certain equipment does not perform other functions or is ineffective in its space requirements, there are additional logistical burdens which can make the equipment undesirable for certain users.

Specifically with respect to desks, or portions thereof, various types of storage equipment have been configured to serve as part of a desk assembly. A number of deficiencies associated with these items detracts from their widespread use. For example, such apparatus includes awkward, complicated and obtrusive hardware having parts extending well beyond the surfaces of connecting items. This obtrusive hardware makes it difficult to employ certain equipment on the desk such as computers, electronic modules, and other desk top apparatus. In addition, where exposed, the hardware can damage adjacent storage members and injure personnel actually using the equipment.

Other systems, although readily convertible to a field desk, cannot function efficiently as storage units. Exposed hardware detract from stacking or arranging the units in a desirable form. Often elements required for assembly must be stored separately, which creates the potential of loss during transport.

The invention described herein has overcome many of the deficiencies discussed above. The inventive system includes storage units which can readily be converted to a field desk without the need of any additional equipment. When the system is disassembled, the storage units are fully operable as containers for shipping and stacking purposes with few, if any, element of the storage unit being lost as a functional item.

For example, in one embodiment of the invention, two storage units can be utilized for shipping and at the destination as a desk. Each unit contains its respective top portion and bottom portion. During storage and shipping, the top portion is fixedly secured to the bottom portion. Once the destination has been reached, the top portion can be unlatched from the bottom portion and removed to expose the interior portion of the container. The interior of the bottom portion can include shelves, drawers, or bins which would normally be used with the desk. And, in fact, these various items can include equipment which personnel expect to use once the desk is erected.

Separable fastener means enable the top portion of the storage member to be attached to the bottom portion of the storage member to form a desk therewith such that useful surfaces are generally coplanar. The end of the top portion distal from the storage member to which it is initially attached can be secured to another storage container or some other support mechanism.

With this system, coplanar surfaces are achieved with storage members or containers in stacked disposition or when arranged as a desk. When the desk is formed, the storage members or containers are oriented to expose shelves and cabinets for use by personnel sitting at the desk. None of the hardware is sufficiently exposed to injure the personnel or otherwise interfere with the stacking and shipping of the system.

The separable fastener configuration which permits this attachment remains fixed to its respective portion of a container. A tongue portion is fixed to the undersurface of the top portion of the container for movement between a retracted and an extended position. A complementary part within a recess on sidewall of the container is configured for interengagement with the tongue. This configuration permits a secure engagement without exposing hardware beyond the surface of the other elements of the system.

In an alternative embodiment rather than using another storage member, a foldable leg can be employed to support a portion of the desk remote from the interface between the top portion and the bottom portion when the separable fastener elements are interengaged to form a field desk. The foldable leg is U-shaped and configured to fit well within the sidewalls forming the top portion of the container. Consequently, when the top portion is fitted onto the bottom portion, there should be little or no interference between one part of the separable fastener, the foldable leg, and the other elements such as drawers, and files which can be utilized in the bottom portion of the container.

The above has been a brief discussion of deficiencies in the prior art and advantages of the invention described herein. Other advantages will be appreciated from the detailed description of the preferred embodiment which follows.

BRIEF DESCRIPTION OF THE DRAWINGS

FIG. 6 is a perspective view of a top portion connected to two bottom portions of storage containers shown in FIG. 1 with a portion of the top portion cut away.

FIG. 7 is an enlarged perspective view of the separable fastener in an engaged position.

FIG. 8 is a partial view of another embodiment of the invention.

DETAILED DISCUSSION OF THE PREFERRED EMBODIMENT

Figure 1:
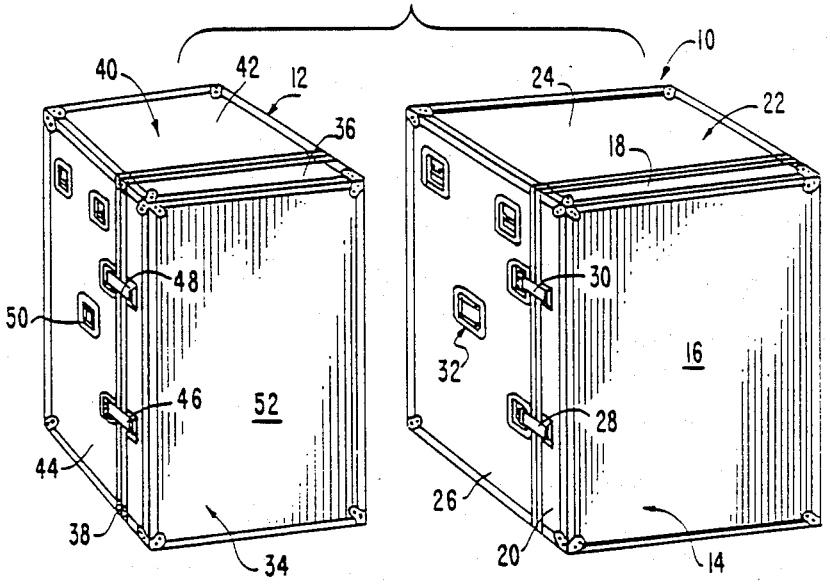
FIG. 1 is a perspective view of two storage members, or containers, of the invention with the top in a closed position.

As can be seen in FIG. 1, each of two storage containers 10 and 12 has a top portion and a bottom portion of orthogonal configuration. The first storage member 10 includes a top portion 14 secured to a bottom portion 22 by latches 21 as shown. The top portion 14 includes a top surface 16 with top sidewalls 18, 20, 22, and 24 which are generally coplanar with corresponding bottom sidewalls 24, 25, 26, 29, and 27 of bottom portion 22. Latches 28 and 30 on top sidewall 20 engage complementary latches on sidewall 26 as can be seen in FIG. 1. Corresponding latches 31 and 33 exist on opposite side 22 which are not shown in FIG. 1. Handles recessed into the sides of the wall are provided at 32 on sides 26 and 30 of the bottom portion to permit easy moving and lifting of the storage container 10.

Container 12 is similar in configuration to container 10 except certain dimensions, primarily the width dimension, are somewhat smaller; however, they could be identical if so desired. Container 12 includes top portion 34 and bottom portion 40 which are in a closed position as shown in FIG. 1. The top portion 34 includes top surface 52 surrounded by top sidewall surfaces 36, 38, 37, and 39 which are generally coplanar with surfaces 42, 44, 43, and 45 of bottom portion 40. As with the container 10, the container 12 includes latches 46 and 48 extending from surface 38 to engage complementary members on surface 44 of the bottom portion. Similar latching mechanism exists on opposing surfaces to interlock between surfaces 39 and 43. Container 10 also includes a handle 50 located in a recess to permit easy movement of the container when stacking and storing the equipment.

Figure 2:
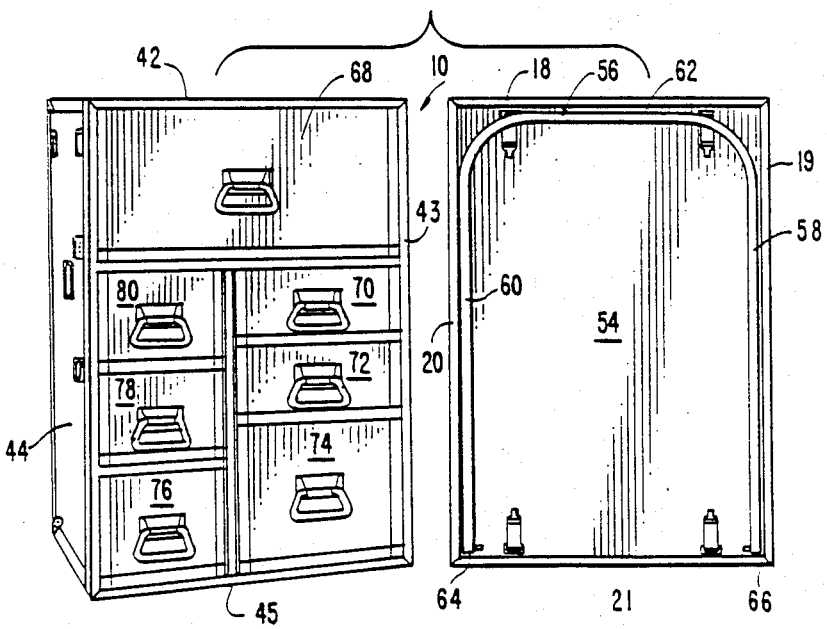
FIG. 2 is a perspective view of one of the containers in FIG. 1 with the top portion removed.

The top can be removed by unlatching the top portion 14 through operation of the latches 28 and 30 as shown in FIG. 1. Corresponding latches on 31 and 33 not shown are similarly unlatched. Top portion 14 is then moved to an open position completely removed from the bottom portion as shown in FIG. 2. Here it can be seen that on the undersurface 54 of top portion 14, there is provided a support member 56. In this particular embodiment, support member 56 is U-shaped in configuration having legs 58 and 60 connected by a cross member 62. The legs are pinned at opposed ends from the cross members at pin 64 and 66. With this configuration, the support member 56 can be pivoted outwardly as shown in FIG. 8 and locked into the open position by a linkage commonly used for this purpose. The dimensions chosen for this particular embodiment is one where the length of the top portion 14 is the same dimension that one would expect a desk top to be extended from the ground. Correspondingly, when the leg portion is extended as shown in FIG. 8, top portion 14 will be supported the proper distance above the ground for personnel in a seated position at the front of the desk.

Figure 9:
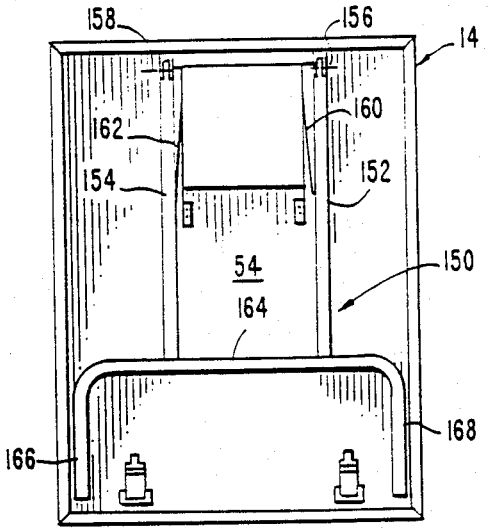
FIG. 9 is a plan view of another embodiment of a top portion of a storage member.

Although a U-shaped leg is shown in FIG. 2, other configurations can be employed. For example, as shown in FIG. 9, banquet leg 150 is used in lieu of the U-shaped leg shown in FIG. 2. The banquet leg system includes two (2) feet 166, 168 which when folded into the undersurface lie adjacent the edges of undersurface 54 of top 14. Cross-member 164 connect the two feet 166 and 168 to two legs 152, 154 which in turn are pivoted about pivot pins 156, 158 at a position on undersurface 54 remote from feet 166, 168 as shown. A linkage or bracket mechanism 160, 162 cooperate with the legs 152, 154 to lock them in place once extended to a support position similar to that shown in FIG. 8. As the operation of banquet leg 150 is substantially identical to that of the U-shaped leg, it need not be reiterated here.

Figure 10:
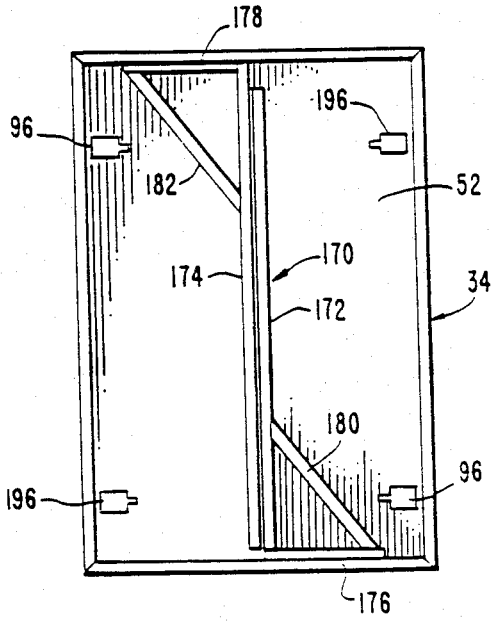
FIG. 10 is a plan view of the top portion of another storage member.

Top 34 can also be provided with support legs 170 and tongue members 96, as shown in FIG. 10. In this particular embodiment, foldable leg system 170 includes two (2) card table legs 172, 174 folded along the center line of top 34. Each leg 172, 174 pivots about its pivot bar 176, 178 respectively to fold out in a support position similar to that shown in FIG. 8. Brackets 180 and 182 connect respective pivot bars 176, 178 to corresponding legs 172, 174 for providing additional stability and support. Not shown are linkage or bracket mechanism for holding the legs 172, 174 in an open or extended position similar to that shown in FIG. 8 for the U-shaped member.

Top portion 34 also has four (4) tongue members 96 for attaching the top portion 34 to a container in the same manner as top portion 14. This permits top portion 34 to be secured to container 12 to form an extension of the desk, as shown in FIG. 6 when attached to container 12 on a side opposite to that of top 14.

The bottom portion of the storage member 22 is already provided with a number of drawers with pulls which could be utilized in any type of desk. In this particular preferred embodiment, bottom portion is provided with a large drawer 68 and several small drawers 70, 72, 74, 76, 78, and 80. It should be understood that the drawers can be replaced by file cabinets, disks, computer equipment, or any other equipment properly stored as desired.

As shown in FIG. 2, the orientation of the container 10 as shown in FIG. 1 has been changed such that the drawers are in their normal position of use. In this manner, once the top portion is removed, it can simply be attached to sidewall 44 or sidewall 26 to form a desk as this can be better be seen in FIG. 6.

Figure 3:
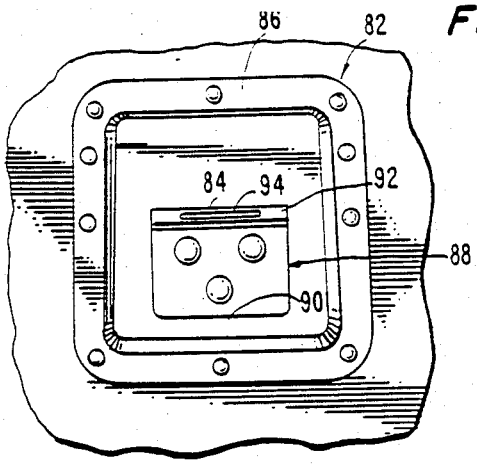
FIG. 3 is a perspective view of a recessed member having one part of the separable fastener of the invention.

The separable fastener mechanism which permits the top portion 14 and the bottom portion 16 to be joined as described above is more clearly shown in FIGS. 3, 4, 5, and 7. The separable fastener means in this embodiment basically includes two parts: the recess member 82, and the tongue member 96. The recess member is a rigid member having a bottom 84 and a flange member 86 completely surrounding the bottom member and displaced therefrom by sidewalls. In this embodiment, the recess member is rectangular in configuration as can be seen in FIG. 3. On the bottom surface 84 of the recess member 82 there is provided a slot bracket 88 which has one angle member 90 fixed to the bottom 84 and another lateral member 92 extending laterally therefrom generally in the center of the recess member 82. Slot 94 is formed entirely through the lateral member 92 for receiving a portion of the separable fastener member 96 described below.

The first separable fastener member 96 includes a tongue member 98 which is pivotedly secured at base portion 108 to channel member 110. Tongue member 98 defines leg 100 extending from the base member 108 offset by offset portion 104. Slot engaging member 202 at the most distal portion of tongue member 98 has a cross section more narrow than the proximate point as defined at shoulders 106 where it is connected to offset portion 104. In this manner, the slot engaging member 202 can readily fit within the slot 94 which has a length and width dimensions greater than that of the member 202. Shoulder portion 106 of tongue 98 will engage the lateral member 92 defining the slot to prevent further insertion as can be seen in FIG. 7.

Figure 4:
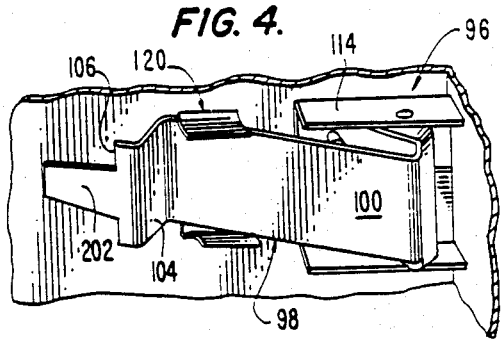
FIG. 4 is an enlarged perspective view of another part of the separable fastener in a closed position.
Figure 5:
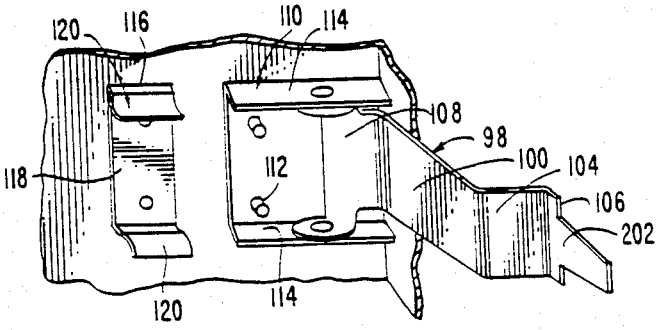
FIG. 5 is the perspective view of a separable fastener as shown in FIG. 4 in an open position.

As can be seen in FIGS. 4 and 5, base 110 is riveted to the undersurface 54 with sidewalls 114 extending perpendicularly from the bottom 112 of channel member 110. Adjacent to channel member 110 there is provided a clamp member 120 which is formed by plate 118 having extending therefrom two (2) opposed convex resilient metal members for frictional engagement with the leg 100 of the first separable fastener member. With this configuration, the fastener member 98 can be moved between a closed position as shown in FIG. 4 where it engages the convex resilient members 120 to an open or extended position as shown in FIG. 5 where it extends downwardly for engagement with the lateral slot 94 as shown in FIG. 7.

It should be noted that the depth of the recess member is approximately equal to or greater than the width of the offset portion. This permits the top portion 14, as shown in FIG. 6, to be arranged in abutting relationship with sidewall 26 of bottom portion 22. The dimensions of the recess portion, including its width dimensions, are significantly large such that the end portion 202 can extend into the recess before engaging the slot. Similarly, the leg portion 100 is sufficiently long to insure that the offset portion will extend beyond the bottommost surface of the top portion sidewall such that the end member 202 is exposed for extension into the recess member.

In this embodiment, there are six (6) recess members on each container. The recess members forming second parts of the separable fastener are arranged in pairs displaced from one another and in colinear arrangement as can be seen in FIG. 1. The recess members are spaced on the sidewalls (and bottom wall, not shown) of the bottom portion a distance equal to the displacement of the first separable fastener members on the undersurface 54 of the top portion 14. In this manner, the first part of the separable fastener members can readily register with the second part prior to their engagement.

In operation, the containers 10 and 11 with the top portion 14 removed, are stored with the necessary materials. In this case, the drawers are filled with whatever is required for the use of the desk in the field. Once properly filled, the drawers are closed and the top portion moved to a closed position as can be seen in FIG. 1 and secured to the bottom portion by latches 28, 30, 29, and 31. The same operation is completed for the storage member 12. The boxes can be moved and stacked to a desirable loading position with other such containers.

Once they have reached the destination, the containers are unstacked and oriented such that the top portion 14 is facing the user with one of its sidewalls along the ground as shown. The smaller container 12 is similarly arranged. Preferably each container is moved to a position spaced from one another about the length of the top portion 14 as shown in FIG. 6. Once the top portion is removed, the tongue member or first part of the separable fastener is moved from the closed position to an open position as shown in FIG. 5. For each of the four members shown on the undersurface 54 in FIG. 2. Once in open position, the top portion can be moved into fixed engagement with complementary portions on the sidewalls of each of the containers.

Specifically, the end portion 202 is placed into the recess member 82 above the lateral member 92 for engagement with the slot. Once properly oriented on both boxes, or containers, 10 and 12, the top portion 14 is simply moved downwardly so that each end portion 202 of each of the first parts of the separable members can slide downwardly into the slot 84 of lateral portion 92. Once the shoulders have engaged the lateral portion, the top portion 14 is in a fixed position relative to the other elements. As can be seen in FIG. 6, the dimensions are such that once when in place, top portion 14 and specifically top surface 16 is generally coplanar with sidewall surface 24 of container 10 and sidewall surface 42 of container 12. This provides a smooth coplanar surface without any significant impediment to the user for equipment or any other items that are typically used on a desk of this type.

As an alternative embodiment as explained above, rather than attaching one end of the top portion 14 to another container 12, the leg can be used as an additional support means where another container is not available. In that instance, only two of the first parts of the separable fastener need be moved to the open position they will engage the complementary recess members 82 and sidewall 26 of container 10. The end of the top portion not attached to container 10 is supported by moving the support member 56 to the open position and lock it in that position by the linkage as shown in FIG. 8.

To close the system and use the boxes for storage, the operation as described above is simply reversed.

The above has been a detailed description of the preferred embodiments of the invention. The full scope of invention to which the applicant is entitled is set out in the claims which follow. The claims are intended to cover all equivalents of the invention without undue limitation to the specification.

What is claimed:

1. Fastener means for fastening a top portion of a storage member to a bottom portion of a storage member comprising:

(a) first and second fastener members;

(b) said first fastener member including a support member fixed to the top portion of said storage member, and a tongue having a base portion rotatably fixed to said support member and being movable between an open and in closed position; and (c) clamping means for holding said tongue in a closed position;

(d) said second fastener member fixed to said bottom portion of said storage member, and having a first and second opposed walls in spaced relationship and third and fourth opposing walls in spaced relationship, said walls connected by a bottom surface to define a recess, a bracket, said bracket including a lateral portion extending outwardly from said bottom surface with a slot therethrough for receiving said tongue; and (e) said bracket, said tongue and said recess configured to permit fastening of said first fastener member with said second fastener member with said top portion and said bottom portion in abutting relationship.

2. The apparatus according to claim 1 wherein said tongue includes a leg, an offset portion adjacent an end of said leg remote from said support member and generally perpendicular to said leg, said recess having a depth equal to or greater than said offset portion of said tongue, and said tongue having a slot engaging portion for fitting through said slot and a shoulder for engaging the bracket portion defining said slot and supporting said tongue on said bracket.

3. The apparatus according to claim 2 wherein said recess member is dimensioned to permit said offset portion with said slot engaging portion to fit between said lateral member and said opposing walls of said recess.

4. The apparatus according to claim 3 wherein said second fastener member includes the flange about the perimeter having a number of holes therethrough to permit attachment to another surface, said support member being channel shaped member with means for securing said first fastener member to another surface; said clamping member including a channel shaped bar with resilient sides to frictionally engage said tongue and to hold said tongue in a closed position.

5. Fastener means for fastening a top portion of a storage member to a bottom portion of a storage member comprising:

(a) a first fastener member and a second fastener member;

(b) said first fastener member being movably fixed to said top portion for movement between an open and closed position, and said second fastener member fixed to said bottom portion;

(c) said first fastener member having an offset portion and an engaging member extending from said offset portion;

(d) said second fastener member including sidewalls and a bottom surface defining a recess, a lateral member extending outwardly from said bottom surface having a slot for receiving said engaging member; and (e) said engaging member being dimensioned to fit between one of said sidewalls and said lateral member.

* * * * *